US008976024B2

(12) United States Patent
Brave et al.

(10) Patent No.: US 8,976,024 B2
(45) Date of Patent: Mar. 10, 2015

(54) SYSTEMS AND METHODS FOR ELECTRONIC CONTROL DEVICE WITH DEACTIVATION ALERT

(75) Inventors: Michael A. Brave, Scottsdale, AZ (US); Michael E. Gish, Phoenix, AZ (US); Patrick W. Smith, Scottsdale, AZ (US)

(73) Assignee: TASER International, Inc., Scottsdale, AZ (US)

( * ) Notice: Subject to any disclaimer, the term of this patent is extended or adjusted under 35 U.S.C. 154(b) by 159 days.

(21) Appl. No.: 13/088,249

(22) Filed: Apr. 15, 2011

(65) Prior Publication Data

US 2012/0262293 A1 Oct. 18, 2012

(51) Int. Cl.

| | |
|---|---|
| ***G08B 21/00*** | (2006.01) |
| ***H05C 1/04*** | (2006.01) |
| ***F41H 13/00*** | (2006.01) |
| *H01T 23/00* | (2006.01) |

(52) U.S. Cl.

CPC ..... *H05C 1/04* (2013.01); *F41H 13/0018* (2013.01); *F41H 13/0025* (2013.01)

USPC ..... 340/540; 361/232

(58) Field of Classification Search

CPC ... H05C 1/04; F41H 13/0012; F41H 13/0031; F41H 13/0018; F41H 13/0025

USPC ..... 340/540; 361/232

See application file for complete search history.

(56) References Cited

U.S. PATENT DOCUMENTS

| | | | | |
|---|---|---|---|---|
| 4,486,807 | A | 12/1984 | Yanez | |
| 5,193,048 | A | 3/1993 | Kaufman | |
| 5,304,211 | A | 4/1994 | Israel | |
| 5,654,867 | A | 8/1997 | Murray | |
| 5,962,806 | A | 10/1999 | Coakley | |
| 6,563,940 | B2 | 5/2003 | Recce | |
| 7,520,081 | B2 | 4/2009 | Kroll | |
| 7,586,733 | B2 * | 9/2009 | Nerheim | 361/232 |
| 7,602,597 | B2 | 10/2009 | Smith | |
| 7,602,598 | B2 | 10/2009 | Nerheim | |
| 7,778,004 | B2 | 8/2010 | Nerheim | |
| 7,900,388 | B2 | 3/2011 | Brundula | |
| 7,944,676 | B2 | 5/2011 | Smith | |
| 2005/0155270 | A1 | 7/2005 | Snyder | |
| 2008/0158769 | A1 | 7/2008 | Brundula | |
| 2009/0316326 | A1 | 12/2009 | Chiles | |
| 2009/0319007 | A1 | 12/2009 | McNulty | |
| 2011/0001619 | A1 * | 1/2011 | Danon et al. | 340/540 |

FOREIGN PATENT DOCUMENTS

| | | |
|---|---|---|
| EP | 722270 | 2/1998 |

* cited by examiner

*Primary Examiner* — Brian Zimmerman

*Assistant Examiner* — Bhavin M Patel

(74) *Attorney, Agent, or Firm* — Lawrence Letham; William R. Bachand

(57) ABSTRACT

An electronic control device for interfering with locomotion by a human or animal target includes a processor and stimulus signal generator. Upon engagement of a trigger by an operator, a stimulus signal is provided to electrodes for a time period to interfere with the skeletal muscles of the target. An indication is provided to the operator corresponding to the time period to alert the operator before deactivation of the stimulus signal. In response to the alert, the operator may reengage the trigger to continue or resume the stimulus signal.

8 Claims, 5 Drawing Sheets

SYSTEMS AND METHODS FOR ELECTRONIC CONTROL DEVICE WITH DEACTIVATION ALERT

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
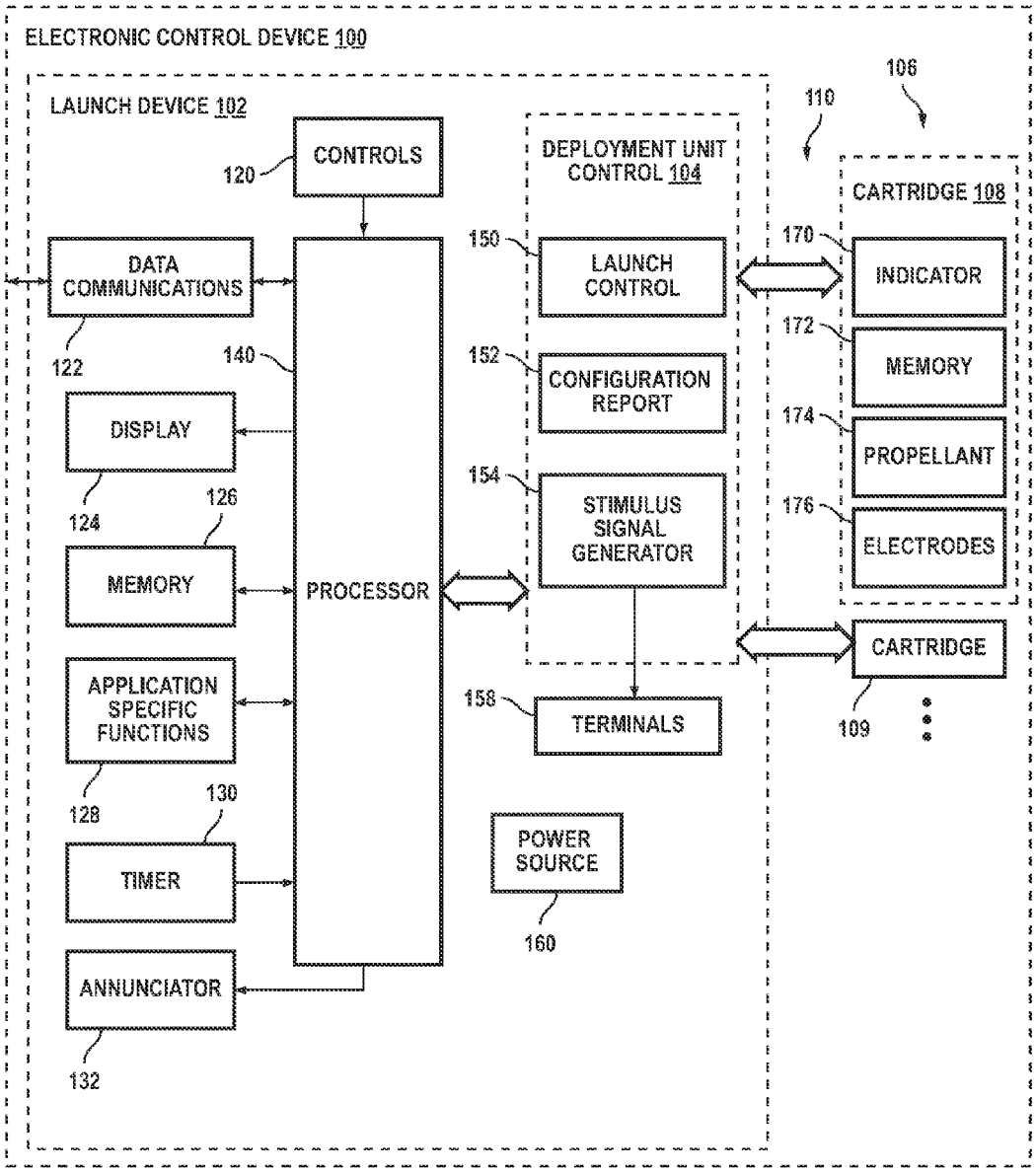
FIG. 1 is a functional block diagram of a system comprising an electronic control device according to various aspects of the present invention.

Greater utilization and increased effectiveness of an electronic control device that delivers a time-limited stimulus can be achieved by alerting the user to termination of the stimulus. Once alerted, the user may choose to continue or reapply the stimulus thus increasing the device's effectiveness.

A conventional electronic control device may perform a contact (or proximate) stun function (herein called a local stun function) to subdue an animal or person (herein called a target) by abutting (or bringing proximate) at least two terminals of the device to the skin or clothing of the target. A conventional electronic control device may perform a remote stun function to subdue a target by launching one or more wire tethered electrodes from the device to the target so that the electrodes are proximate to or impale the skin or clothing of the target. In a stun function, either the local stun function or the remote stun function, an electric circuit is formed for passing a pulsing current through a portion of the tissue of the target to interfere with skeletal muscle control by the target. When a terminal or an electrode is proximate to the tissue of the target, air near the tissue may be ionized to complete a circuit for current to flow through the tissue of the target.

An electronic control device according to various aspects of the present invention may perform alternatively the local stun function and the remote stun function without operator intervention to mechanically reconfigure the electronic control device. The local stun function is available at the front face of the electronic control device whether or not a cartridge (spent or unspent) is loaded. Multiple unspent cartridges may be loaded individually, by a clip, or by a magazine prior to use of the electronic control device to provide multiple operations of the remote stun function.

The stun function (local or remote) may be initiated by a user (person, operator, officer) engaging a trigger by, for example, squeezing, pulling or pushing on the electronic control device. Upon trigger engagement, the duration of the pulsing current may be limited to a predetermined duration (e.g., cycle, stage, interval, period) by the electronic control device's processor. For example, upon trigger engagement, the stun function (e.g., generation of a stimulus signal or current) may be initiated and continue for about 5 seconds. If the user determines that the stun function requires a duration longer than the predetermined length of time or reapplication of the stun function, the trigger may be released and reengaged to provide an additional time duration for the pulsing current. Due to the possible stress experienced by the user or for other reasons during the deployment of an electronic control device, the user may be unaware of a deactivation of the stun function.

According to various aspects of the present invention, an alert may be provided to the user prior to, coincident with, or following the lapse of a predetermined duration. Further, such an alert may prompt the user to reengage the trigger if an additional or longer duration stun function is desired.

Electrodes, tether wires, and a propellant system are conventionally packaged as a cartridge that is mounted on the electronic control device to form an electronic control device for a single remote stun use. After deployment of the electrodes, the spent cartridge is removed from the electronic control device and replaced with another cartridge. A cartridge may include several electrodes launched at once as a set, launched at various times as sets, or individually launched. A cartridge may have several sets of electrodes each for independent launch in a manner similar to a magazine.

An electronic control device according to various aspects of the present invention maintains several cartridges ready for use. If, for example, a first attempted remote stun function is not successful (e.g., an electrode misses the target or the electrodes short together), a second cartridge may be used without operator intervention to mechanically reconfigure the electronic control device. Several cartridges may be mounted simultaneously (e.g., as a clip or magazine), or sequentially (e.g., any cartridge may be removed and replaced independently of the other cartridges).

Accuracy of a remote stun function is dependent on, among other things, a repeatable trajectory of each electrode launched away from the electronic control device. A conventional cartridge includes a delivery cavity for holding the electrode prior to delivery and for guiding the electrode during the early moments of deployment. Deployment is conventionally accomplished by a sudden release of gas (e.g., pyrotechnic gas production or rupture of a cylinder of compressed gas). The electrode and the delivery cavity are kept free of contamination by being tightly covered. When the electrode is deployed, it pulls its wire tether from a wire store so that the wire tether extends behind the electrode to the electronic control device during flight.

A conventional cartridge may be constructed to provide a suitable range of effective distance. The range of effective distance provides a suitable spread of electrodes (e.g., greater than about 6 inches (15 cm)) on impact with the target when the target exists at a specified range of distances from the electronic control device (e.g., from about 6 to about 15 feet (2 m to 5 m)).

An electronic control device supports use of a set of cartridges each cartridge (or magazine) providing to the device various indicia of its capabilities (or codes from which capabilities may be determined). A cartridge, a clip, and a magazine are particular examples of apparatus generally referred to herein as a deployment unit. The electronic control device may be operated to launch a particular cartridge (or particular electrode set of a cartridge having several sets of electrodes) suitable for a particular application of the remote stun function.

Greater utility and/or improved effectiveness are accomplished by an electronic control device providing an alert to the user of cessation of the stun function that is constructed and operated according to various aspects of the present invention. For example, electronic control device 100 of FIGS. 1-4 includes launch device 102 cooperating with a deployment unit 106 comprising at least one cartridge 108.

Each cartridge 108, 109 may be a separate unit or joined together to form a mechanical assembly of cartridges. A deployment unit 106 may include one or more cartridges, one or more magazines, and/or one or more clips of cartridges. An electronic control device may include one or more physically separate deployment units, for example, for redundancy, back up, or for an array covering an area. Deployment unit 106 comprises a set of cartridges 108 and 109 that may be mounted to launch device 102 individually or as a set, for example, in one or more clips or magazines. Deployment unit 106 may include one or more cartridges (e.g., 2 (as shown), 3, 4, 5, 6, or more). When each cartridge is spent, the cartridge may be replaced individually. Cartridges in deployment unit 106 may be identical or may vary (e.g., inter alia, in capabilities, manufacturer, manufacturing date).

A launch device includes any device for operating one or more deployment units. A launch device may be packaged as a contact stun device, baton, shield, stun gun, hand gun, rifle, mortar, grenade, projectile, mine, or area protection device. For example, a gun type launch device may be hand-held by an operator to operate one or more cartridges at a time from a set or magazine of cartridges. A mine type launch device (also called an area denial device) may be remotely operated (or operated by a sensor such as a trip wire) to launch one or more cartridges substantially simultaneously. A grenade type launch device may be operated from a timer to launch one or more cartridges substantially simultaneously. A projectile type launch device may be operated from a timer or target sensor to launch plural electrode sets at multiple targets. The functions of these various launch devices may be understood from a functional block diagram applicable to these launch devices. For example, launch device 102 (of FIG. 1) includes controls 120, data communication 122, display 124, memory 126, application specific functions 128, timer 130, annunciator 132, processor 140, terminals 158, and deployment unit control 104. Deployment unit control 104 includes configuration report function 152, launch control function 150, and stimulus signal generator 154. Components of launch device 102 cooperate to provide all of the functions discussed above. Other combinations of less than all of these functions may be implemented according to the present invention.

Launch device 102 communicates with each cartridge 108 and 109 of deployment unit 106 via an electrical interface 110. By interface 110, launch device 102 may provide power, launch control signals, and stimulus signals to each cartridge. Various ones of these signals may be in common or (preferably) unique to each cartridge. Each cartridge 108 and 109 may provide signals to launch device 102 that convey indicia, for example, of capabilities, as discussed above and described further below.

Launch device 102 in various forms as discussed above includes controls operated by the target (e.g., an area denial device), by a user or operator (e.g., a handgun type device), or by timing or sensor circuits (e.g., a grenade type device). A control includes any conventional manual or automatic interface circuit, such as a manually operated switch or relay. Controls may be implemented using a graphical user interface (e.g., a graphical display, a pointing device, or a touch screen display).

For a handgun type device, controls 120 may include any one or more of a safety control, a trigger control, a range priority control, and a stimulate control. The safety control (e.g., binary switch) may be read by processor 140 and effect a general enablement or disablement of the trigger control and stimulus signal generator 154. The trigger control may be read by processor 140 to effect operation (150) of a propellant 174 in a particular cartridge 108. The range priority control may be read by processor 140 and effect selection by the processor of the cartridge to operate in response to a next operation of the trigger control in accordance with a range of effective distance for the intended application indicated by the range priority control. The stimulate control, when operated, may initiate another delivery of one or more stimulus signals for a local stun function via terminals 158 or via electrodes 176 of cartridge 108. The electrodes 176 may deliver the additional stimulus signals via terminals for a local stun function.

A data communication function performs wired and/or wireless sending and receiving of data using any conventional protocols and circuits. Via data communications, processor 140 may receive software to be performed by processor 140, receive presentations for display 124, receive updated configuration information describing launch device 102 and/or deployment units 106, and/or report data gathered by processor 140.

A display provides presentations of information and may further present icons for controls as discussed above. Any conventional display may be used. For example, display 124 receives information from processor 140, presents the information to an operator of launch device 102 and may receive inputs (e.g., touch screen functions) reported back to processor 140.

A memory for processor instructions, logging of event occurrences, and other device or usage indicia may be contained within processor 140 or be packaged as a separate device. For example, memory 126 may be any conventional analog or digital electronic storage device or circuit (e.g., flash memory) that processor 140 may access to perform the functions discussed above. Memory 126 may include any conventional nonvolatile semiconductor, magnetic, or optical memory.

An application specific function communicates with processor 140 to facilitate more effective use of launch device 102 in a particular application or type of applications. Application specific functions 128 may provide software to processor 140 and include sensors and input/output (I/O) devices. The warning, local stun, and remote stun functions are referred to herein as primary functions.

A timer measures one or more time durations. Timer 130 may interrupt processor 140 and/or activate annunciator 132 when a time duration limit is reached. Time duration limits may be set by processor 140. Processor 140 may read from the timer a value of an accumulated extent of time duration from a start signal or a time remaining to the duration limit. Timer 130 may be implemented with circuitry and/or software of processor 140. Timer 130 may be implemented with a separate component of launch device 102.

A clock may be used to achieve the results or perform the functionality of timer 130. A clock indicates present time. Time durations may be determined by the processor by accumulating the difference between successive readings of the clock. The processor may compare the time durations with the duration limit to determine when the limit is reached. The duration limit may be added to the start time read by the processor and used to set an alarm time in the clock. The clock may interrupt the processor and/or activate the annunciator when the alarm time is reached. The clock may be implemented with circuitry and/or software of processor 140. A clock may be implemented with a separate component of launch device 102.

An annunciator provides an indication to alert the user. Processor 140 may activate or "turn-on" annunciator 132 upon detecting that one or more time duration limits have been reached. Alternatively, timer 130 may activate annunciator 132 upon reaching the time duration limits. An annunciator includes any device that may provide a visual, audio, and/or other signal to attract the attention of the user. Any conventional methods for annunciating may be employed. For example, a function of annunciator 132 may be performed by an electronic buzzer, an electromechanical speaker providing an audible sound, a vibrator on or within the electronic control device, or a visual indicator.

A processor includes any circuit that performs functions in accordance with a stored program. For example, processor 140 may include a processor and memory, and/or a conventional sequential machine that executes microcode or assembly language instructions from memory. Processing circuits may include one or more microprocessors, microcontrollers, application specific integrated circuits, digital signal processors, programmable gate arrays, or programmable logic devices. Conventional technologies may be used to implement processor circuitry and programming.

A configuration report function includes any function that collects information describing the operating conditions and configuration of an electronic control device. The collected information may be the result of functional tests performed by a configuration report function or by another circuit or processor. Collected information may be reported by the configuration report function or simply made available by the configuration report function to other functions (e.g., data communication function 122, processor 140, memory 172). For example, configuration report function 152 of deployment unit 104 cooperates with indicator(s) or performs data communication with indicator(s) 170 of deployment units (e.g., indicators of cartridges 108, and 109) and reports results to processor 140. Processor 140 may use these results to properly perform any warning, local stun, and/or remote stun functions using suitable portions of one or more deployment units 106. Further, processor 140 may interact with data communication function 122 and/or deployment unit control function 104 to transfer collected information to other systems or to a memory of a deployment unit.

For example, a description of the configuration of launch device 102 and the currently installed deployment unit(s) may be collected preferably with functional test results and stored in memory 172 just prior to or just following deployment of cartridge 108. The same collected information may be associated with performance of a particular primary function (e.g., at a particular date, time, operator (128), and/or location (128)) combined with audio (128), video (128), and other data and transferred immediately or at a suitable time via data communication function 122 (e.g., at the end of the operator's shift).

A launch control function provides a signal sufficient to activate a propellant. For example, launch control function 150 provides an electrical signal for operation of an electrically fired pyrotechnic primer. Interface 110 may be implemented with one conductor to each propellant 174 (e.g., a pin) and a return electrical path through the body of propellant 174, the body of cartridge 108, and/or the body of launch device 102.

A stimulus signal generator includes any circuit for generating a stimulus signal for passing a current through tissue of the target for pain compliance and/or for interfering with operation of skeletal muscles by the target. Any conventional stimulus signal may be used. For example, stimulus signal generator 154 in one implementation may deliver about 5 seconds of 19 pulses per second, each pulse transferring about 100 microcoulombs of charge through the tissue in about 100 microseconds. Stimulus signal generator 154 may have a common interface to all cartridges of deployment unit 106 in parallel (e.g., simultaneous operation), or may have an individual independently operating interface to each cartridge 108, 109 (as shown).

Launch device 102 in configurations according to various aspects of the present invention launches any one or more electrodes of deployment unit 106 and provides the stimulus signal to any combination of electrodes for a remote stun function. For example, launch control function 150 may provide a unique signal to each of several interfaces 110, each cartridge (108, 109) of the deployment unit having one independently operated interface 110. Stimulus signal generator 154 may provide a unique signal to each of several sets of electrodes for remote stun. Stimulus signal generator 154 may provide a unique signal to each cartridge (108, 109) of the deployment unit. Terminals for a local stun function may be located on launch device 102 and/or on one or more cartridges of deployment unit 106. In one implementation, launch device 102 provides a local stun function by coupling stimulus signal generator 154 to any one or more terminals 158 located at a face of the launch device. According to various aspects of the present invention, such terminals 158 cooperate with the wire stores of a cartridge to also activate electrodes of the cartridge for a remote stun function after launch.

Operation of an electronic control device having such a launch device and deployment unit facilitates multiple function operation. For instance, a set of electrodes may first be deployed for a remote stun function and subsequently a set of terminals (e.g., of an unspent cartridge) may then be used for a local stun function or for displaying an arc (e.g., as an audible and/or visible warning). When more than one set of electrodes have been deployed for remote stun functions, the remote stun functions may be performed on a selected target or on multiple targets (e.g., stimulus signals provided in rapid sequence among electrodes or provided simultaneously to multiple electrodes).

A cartridge includes one or more wire tethered electrodes, a wire store for each electrode, and a propellant. The thin wire is sometimes referred to as a filament. Upon installation to launch device 102 of a deployment unit having a cartridge, launch device 102 determines the capabilities of at least one and preferably all cartridges of the deployment unit. Launch device 102 may write information to be stored by the cartridge (e.g., inter alia, identity of the launch device, identity of the operator, configuration of the launch device, GPS position of the launch device, date/time, primary function performed).

On operation of a warning control of controls 120, launch device 102 provides a stimulus signal to terminals 158 for a local stun function. On operation of a trigger control of controls 120, launch device 102 provides a launch signal to one or more cartridges of a deployment unit 106 to be launched and may provide a stimulus signal to each cartridge to be used for a remote stun function. Determination of which cartridge(s) to launch may be accomplished by launch device 102 with reference to capabilities of the installed cartridges and/or operation of controls 120 by an operator. According to various aspects of the present invention, the launch signal has a voltage substantially less than a voltage of the stimulus signal; and, the launch signal and stimulus signal may be provided simultaneously or independently according to controls 120 and/or according to a configuration of launch device 102.

As discussed above, a cartridge includes any expendable package having one or more wire tethered electrodes. As such, a magazine or a clip is a type of cartridge. According to various aspects of the present invention, cartridge 108 (109) of FIG. 1 includes an interface 110, an indicator 170, a memory 172, a propellant 174, and electrodes 176. In another implementation, indicator 170 is omitted and memory 172 performs functions of providing any or all of the indications discussed below with reference to indicator 170. In another implementation, memory 172 is omitted for decreasing the cost and complexity of the cartridge.

Interface 110 supports communication in any conventional manner and as discussed herein. Interface 110 may include mechanical and/or electrical structures for communication. Communication may include conducting electrical signals (e.g., connectors, contacts, spark gaps), supporting magnetic circuits, and passing optical signals.

An indicator includes any apparatus that provides information to a launch device. An indicator cooperates with a launch device for automatic communication of indicia conveying information from the indicator to the launch device. Information may be communicated in any conventional manner including sourcing a signal by the indicator or modulating by the indicator a signal sourced by the launch device. Information may be conveyed by any conventional property of the communicated signal. For example, indicator 170 may include a passive electrical, magnetic, or optical circuit or component to affect an electrical charge, current, electric field, magnetic field, magnetic flux, or radiation (e.g., light) sourced by launch device 102. Presence (or absence) of the charge, current, field, flux, or radiation at a particular time or times may be used to convey information via interface 110. Relative position of the indicator with respect to detectors in launch device 102 may convey information. In various implementations, the indicator may include one or more of any of the following: resistances, capacitances, inductances, magnets, magnetic shunts, resonant circuits, filters, optical fiber, reflective surfaces, and memory devices.

In one implementation, indicator 170 includes a conventional passive radio frequency identification tag circuit (e.g., having an antenna or operating as an antenna). In another implementation, indicator 170 includes a mirrored surface or lens that diverts light sourced by launch device 102 to predetermined locations of detectors or sensitive areas in launch device 102. In another implementation, indicator 170 includes a magnet, the position and polarity thereof being detected by launch device 102 (e.g., via one or more reed switches). In still another implementation, indicator 170 includes one or more portions of a magnetic circuit, the presence and/or relative position of which are detectable by the remainder of the magnetic circuit in launch device 102. In another implementation, indicator 170 is coupled to launch device 102 by a conventional connector (e.g., pin and socket). Indicator 170 may include an impedance through which a current provided by launch device 102 passes. This latter approach is preferred for simplicity but may be less reliable in contaminated environments.

Indicator 170 in various embodiments includes any combination of the above communication technologies. Indicator 170 may communicate using analog and/or digital techniques. When more than one bit of information is to be conveyed, communication may be in serial, time multiplexed, frequency multiplexed, space-division multiplexed, code-division multiplexed, or communicated in parallel (e.g., multiple technologies or multiple channels of the same technology).

The information indicated by indicator 170 may be communicated in a coded manner (e.g., an analog value conveys a numerical code, a communicated value conveys an index into a table in the launch device that more fully describes the meaning of the code). The information may include a description of the deployment unit and/or cartridge 108, including for example, the quantity of uses (e.g., one, plural, quantity remaining) available from this cartridge (e.g., may correspond to the quantity of electrode pairs in the cartridge), a range of effective distance for each remote stun use, whether or not the cartridge is ready for a next remote stun use (e.g., indication of a fully spent cartridge), a range of effective distance for all or the next remote stun use, a manufacturer of the cartridge, a date of manufacture of the cartridge, a capability of the cartridge, an incapability of the cartridge, a cartridge model identifier, a serial number of the cartridge, a compatibility with a model of launch device, an installation orientation of the cartridge (e.g., where plural orientations may be used with different capabilities (e.g., effective distances) in each orientation), and/or any value(s) stored in memory 172 (e.g., stored at the manufacturer, stored by any launch device upon installation of the cartridge with that particular launch device).

A memory includes any analog or digital information storage device. For example, memory 172 may include any conventional nonvolatile semiconductor, magnetic, or optical memory. Memory 172 may include any information as discussed above and may further include any software to be performed by launch device 102. Software may include a driver for this particular cartridge to facilitate suitable (e.g., plug and play) operation of indicator 170, propellant 174, and/or electrodes 176. Such functionality may include a stimulus signal particular to the use the cartridge is supplied to fulfill. For example, one launch device may be compatible with four types of cartridges: military, law enforcement, commercial security, and civilian personal defense, and apply a particular launch control signal or stimulus signal in accordance with software read from memory 172.

A propellant propels electrodes away from a launch device and toward a target. For example, propellant 174 may include a compressed gas container that is opened to drive electrodes via expanding gas escaping the container away from cartridge 108 toward a target (not shown). Propellant 174 may in addition or alternatively include conventional pyrotechnic gas generation capability (e.g., gun powder, a smokeless pistol powder). Preferably, propellant 174 includes an electrically enabled pyrotechnic primer that operates at a relatively low voltage (e.g., less than about 1500 volts) compared to the stimulus signal delivered via electrodes 176.

An electrode brings the stimulus signal into proximity or contact with tissue of the target (e.g., an animal or person). Electrodes 176 may perform both the local stun function and the remote stun function as discussed above. For the remote stun function, electrodes are propelled by propellant 174 away from cartridge 108. Electrodes 176 may provide electrical continuity between a stimulus signal generator 154 in launch device 102 and terminals for the local stun function. Electrodes 176 also provides electrical continuity between the stimulus signal generator 154 in launch device 102 and the captive end of the wire tether for each electrode for the remote stun function. Electrodes 176 receive stimulus control signals from interface 110 and may further include a stimulus signal generator (e.g., to supplement or replace stimulus signal generator 154, for example, for wireless operation away from launch device 102).

Signals in interface 110 between launch device 102 and one or more deployment units (e.g., magazines or cartridges) may be identical, substantially similar, or analogous to communication between a launch device and a cartridge as discussed above with reference to FIG. 1.

Another implementation of an electronic control device, according to various aspects of the present invention, operates with a magazine as discussed above. A magazine may include a package having multiple cartridges or a package having the functions of multiple cartridges without the packaging of each cartridge as a separable unit. Further a magazine may provide some functions in common for all electrodes in the magazine (e.g., a common propulsion system, indicator, or memory function).

A magazine provides mechanical support and may further provide communication support for a plurality of cartridges. A cartridge for use in a magazine may be identical in structure and function to cartridge 108 discussed above except that indicator 170 and memory 172 are omitted. Indicator and memory functions discussed above may be accomplished by the magazine as to all cartridges that are part of the magazine. The indicator and/or memory of the magazine may store or convey information regarding multiple installations, cartridges, and uses. Since such a magazine may be reloaded with cartridges and installed/removed/reinstalled on several launch devices, the date, time, description of cartridge, and description of launch device may be detected, indicated, stored, and/or recalled when change is detected or at a suitable time (e.g., recorded at time of use for a remote stun function). The quantity of uses may be recorded to facilitate periodic maintenance, warranty coverage, failure analysis, or replacement.

An electronic control device according to various aspects of the present invention may include independent electrical interfaces for launch control and stimulus signaling. The launch control interface to a single shot cartridge may include one signal and ground. The launch control signal may be a relatively low voltage binary signal. The stimulus signal may be independently available for local stun functions without and with a cartridge installed in the launch device. The stimulus signal may be available for remote stun functions after the cartridge propellant has been activated.

A deployment unit may include several (e.g., 2 or more) sets of terminals and/or electrodes for a warn function, local stun function, and/or remote stun function. A set may include two or more terminals and/or electrodes. Launch of electrodes may be individual (e.g., for effective placement when the target is too close for adequate separation of electrodes in flight) or as a set (e.g., in rapid succession or simultaneous). In one implementation, a set of electrodes is packaged as a cartridge, the deployment unit comprising several such cartridges. Before the electrodes of the cartridge are launched, a set of terminals of the electronic control device (e.g., part of the launch device or part of a cartridge) may perform a display (e.g., a warning) function or a local stun function. In one implementation, after launch, only the remote stun function is performed from the spent cartridge; and other cartridges are available for the local stun or warn functions. Because the deployment unit includes more than one cartridge each with an independent interface or interfaces, the deployment unit facilitates multiple functions as discussed herein.

For instance, after a first cartridge of such a deployment unit has been deployed toward a first target, stimulus signal generator 154 may be operated to provide a warn function or a local stun function with other terminals of the deployment unit. A second target may be engaged for a second remote stun function. Subsequently, other electrodes of the deployment unit may be used for another warn function or local stun function. The deployment unit may include terminals 158 for the warn and/or local stun functions independent of cartridge configurations (e.g., none, some, or all installed; none, some, or all spent).

In operation, with the safety released, according to various aspects of the present invention, the timer, processor and stimulus signal generator cooperate to produce a local or remote stun function and to measure time durations. In exemplary sequence 201 of FIG. 2A, a trigger is operated or engaged and then released. Operation of the trigger by the user activates a stimulus signal, enabling a primary function at time $T_0$, and begins measurement of two time durations by timer 130 and/or processor 140 as described above. The first time duration corresponds to a time period that the stimulus is active (e.g., stimulus current generated). The timer may count up, count down, or provide elapsed time, until the first time duration 204 limit is reached at time $T_2$ (typically about 5 seconds). At time $T_2$ the stimulus signal is deactivated, disabling the primary function. Upon reaching the second time duration 202 limit at $T_1$, the annunciator is enabled to alert the user to the upcoming disabling of the primary function. The alert may continue until the primary function is disabled at time $T_2$ or continue until time $T_3$, a duration 208 after the stimulus signal is deactivated. The second time duration limit may be less than, equal to, or greater than the first time duration limit. The two time durations may be measured separately or one may be derived from the other. For example, time duration 204 limit may be determined by timer 130 reaching time duration 202 followed by reaching time duration 206.

Figure 2A:
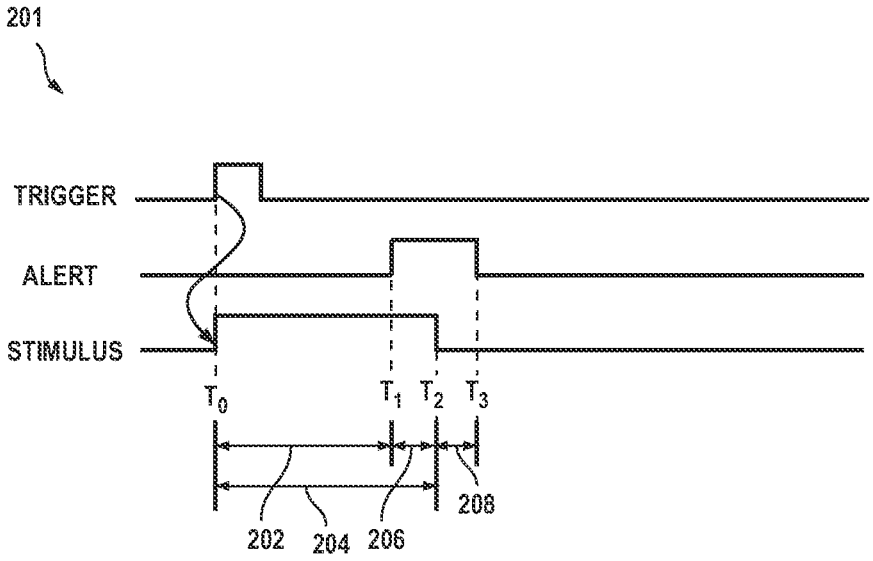
FIGS. 2A, 2B, 2C, and 2D are timing diagrams describing sequences of operations by the system of FIG. 1.
Figure 2B:
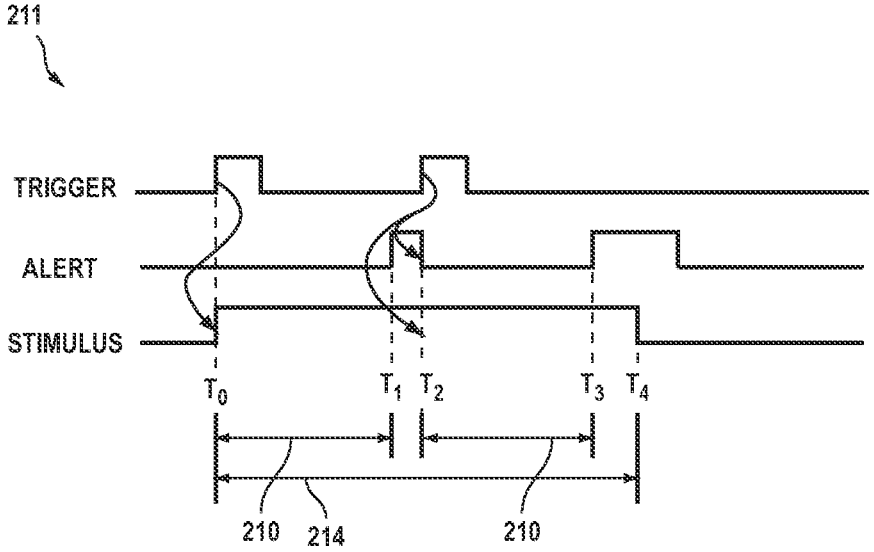
Figure 2C:
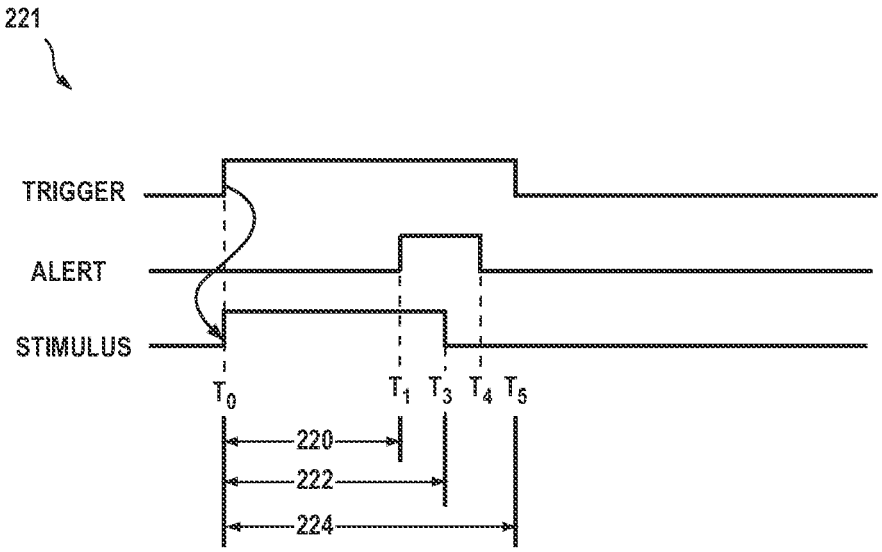

In exemplary sequence 211 of FIG. 2B, the trigger is engaged, then released and reengaged (retriggered) before the first time duration limit has been reached. Operation of the trigger by the user at time $T_0$ activates the stimulus signal and begins measurement of the time durations. Subsequent to reaching the second time duration 210 limit at time $T_1$, but before the first time duration limit is reached and the stimulus is deactivated, the trigger is reengaged at time $T_2$. Reengagement of the trigger at time $T_2$ reinitializes the timer, restarts measurement of the time durations, and removes the alert. The stimulus signal continues from time $T_2$ until the first time duration limit is reached at time $T_4$, resulting in stimulus duration 214. First time duration 210 limit is reached at time $T_3$ and the alert enabled.

Stimulus signal duration is unaffected by continuous operation of the trigger (e.g., user holding the trigger). For example, in exemplary sequence 221 of FIG. 2C, the trigger is operated at time $T_0$ initiating the stimulus signal and measurement of the time durations. While the trigger is held, the alert is enabled when time duration 220 limit is reached. The stimulus signal is deactivated when time duration 222 limit is reached. The trigger is released by the user after time duration 224 at time Ts.

Figure 2D:
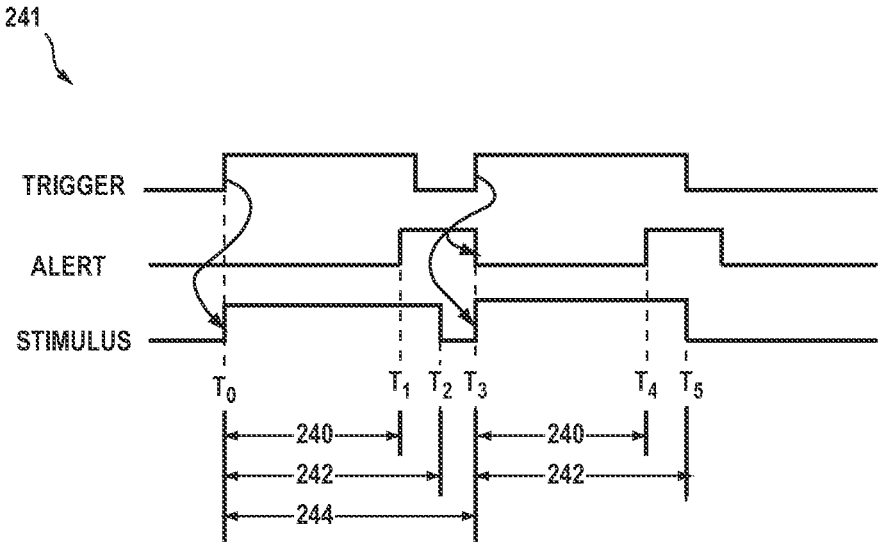
Figure 3:
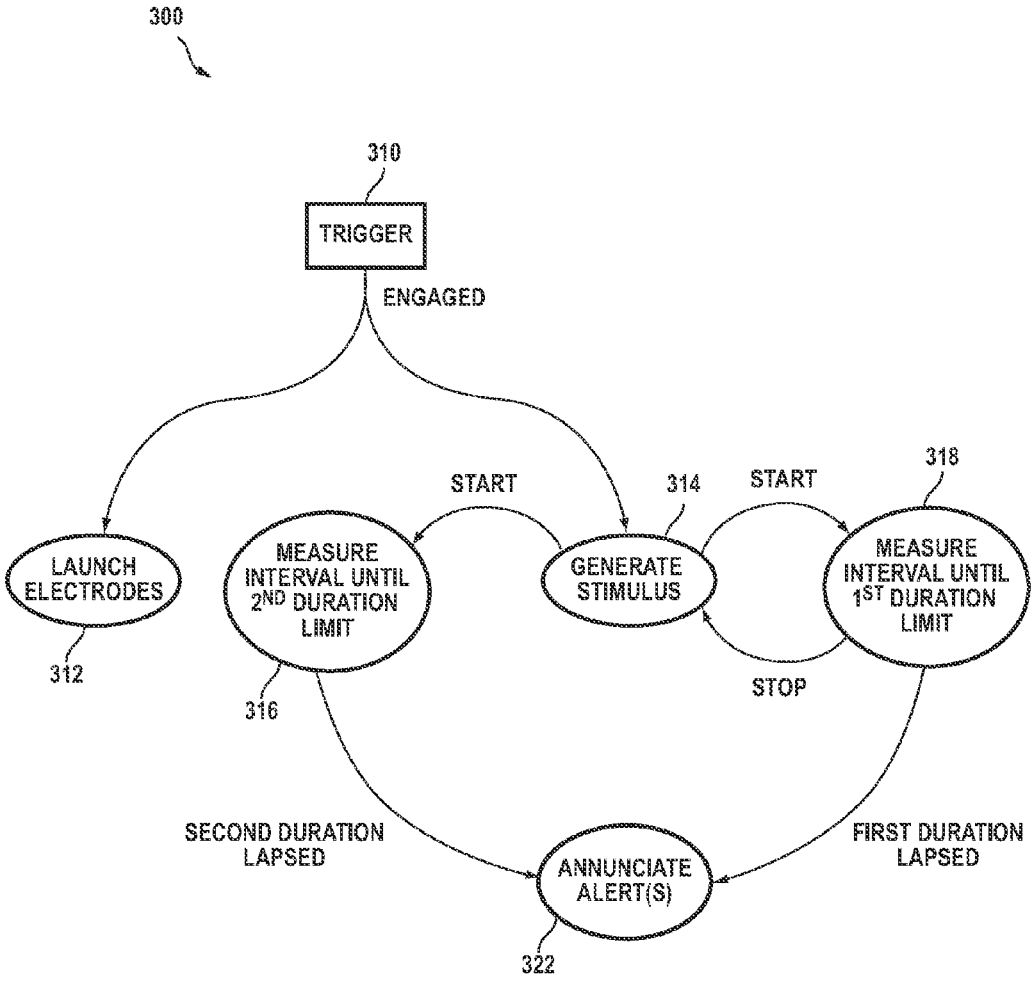
FIG. 3 is a data flow diagram of a method, according to various aspects of the present invention, for annunciating an alert prior to stimulus deactivation.

In exemplary sequence 241 of FIG. 2D, the trigger is engaged by the user, released by the user, and then reengaged by the user after the stimulus signal is deactivated. The trigger is operated at time $T_0$ activating the stimulus signal and measurement of the time durations. The alert is enabled when the second time duration 240 limit is reached at time $T_1$. The stimulus is deactivated when the first time duration 242 limit is reached at time $T_2$. Following deactivation of the stimulus signal, the trigger is reengaged by the user at time $T_3$ which reactivates the stimulus signal, disables the alert (if enabled), and restarts measurement of the time durations. As described by the earlier engagement of the trigger, the alert is enabled when time duration 240 limit is reached at time $T_4$ and the stimulus signal deactivated when time duration 242 limit is reached at time $T_5$. The number of trigger engagements may be limited by the available battery power, and/or by the processor (e.g., a limit in the number of operations within a time period).

In an exemplary implementation of the present invention, processor 140 is a microcontroller (e.g., NXP Cortex-M3) with internal general purpose timers/counters and a processing unit. One of the timers/counters may be programmed for continuous operation with interrupt generation when a match of one or more preset values with the current time or count occurs. The timer/counter may be configured with 1 millisecond resolution from counting cycles of a peripheral clock. In operation, the timer/counter may be reset to zero and start counting upon trigger engagement by the user. Upon the timer/counter value matching a first preset value (e.g., 4,000 for a 4 second time duration), an interrupt is generated and serviced by the processor and an alert enabled. Upon the timer/counter value matching a second preset value (e.g., 5,000 for a 5 second time duration), another interrupt is generated and serviced by the processor to terminate the stun function if the trigger has not been released and reengaged.

A method of providing an alert to warn a user prior to deactivation of a local and/or remote stun function of an electronic control device may be based on the measurement of two time intervals. For example, method 300 of FIG. 3 may cause an alert prior to deactivation of the stun function. Method 300 includes launch electrodes process 312, generate stimulus process 314, measure interval until $1^{st}$ duration limit process 318, measure interval until $2^{nd}$ duration limit process 316, and annunciate alert process 322. Method 300 may be performed to implement any one or more sequences 201, 211, 221, and/or 241

Each process of method 300 may perform its functions whenever sufficient input information is available. For example, processes may perform their functions serially, in parallel, simultaneously, or in an overlapping manner. A system performing method 300 may implement one or more processes in any combination of programmed digital processor logic circuits and/or analog control circuits. Inter-process communication may be accomplished in any conventional manner (e.g., subroutine calls, pointers, stacks, common data areas, messages, interrupts, asynchronous signals, synchronous signals). For example, method 300 may be performed by processor 140 that may control other functions of electronic control device 100 as discussed above.

Launch electrodes process 312 and generate stimulus process 314 begin in response to an engaged signal from trigger 310. Electrodes may be propelled from the electronic control device for a remote stun function by launch electrodes process 312. A local stun function may not require electrodes to be launched. Launch electrodes process 312 determines whether or not electrodes are to be launched and, if so, causes electrodes to be launched.

Generate stimulus process 314 includes any method for delivering stimulus to a load (e.g., a target) to interfere with locomotion as discussed above. A generate stimulus process may control a signal generator. For example, generate stimulus process 314 responds to trigger 310 and begins delivery of energy to provide a stimulus current for a local or remote stun function. A reengagement of the trigger (e.g., retrigger) restarts generate stimulus process 314. A stop signal from measure interval until $1^{st}$ duration limit process 318 results in the cessation of the stimulus current. Generate stimulus process 314 controls measurements of durations (by processes 314 and 316) in response to engagement and reengagement of the trigger by the user. Generate stimulus process 314 provides a unique start signal to each process 314 and 316.

The measure interval until $1^{st}$ duration limit process 318 and measure interval until $2^{nd}$ duration limit process 316 are responsive to respective start signals provided by generate stimulus process 314. A measure interval process may be performed by conventional methods with a processor, timer, and/or clock as described above. Measure interval until $1^{st}$ duration limit process 318 measure the time duration that the generate stimulus process 314 generates stimulus current (e.g., provides a stimulus signal). The lapse of the $2^{nd}$ duration limit, preferably less than the $1^{st}$ duration limit, causes an annunciator to alert the user of the approaching termination of stimulus current generation.

Annunciate alert(s) process 322 provides an alert to the user of the forthcoming termination of the stimulus current. For example, annunciate alert(s) process 322 may be responsive to a first duration lapsed signal from measure interval until $1^{st}$ duration limit process 318 and/or a second duration lapsed signal from measure interval until $2^{nd}$ duration limit process 316. Annunciate alert(s) process 322 may enable or disable an alert in response to either signal. The alert may be provided by any conventional technique discussed above. The alert may be continuously provided until annunciate alert(s) process 322 receives a duration lapsed signal or until a default period of time has elapsed.

Figure 4:
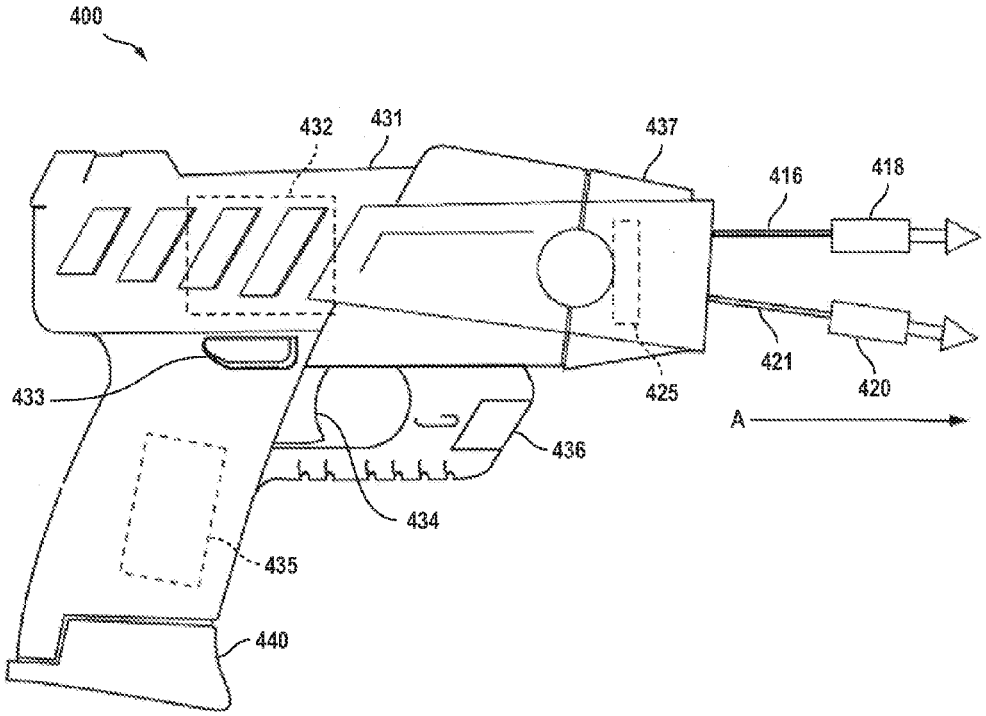
FIG. 4 is a plan view of an electronic control device in accordance with various aspects of the present invention.

An electronic control device 400 of FIG. 4 is constructed in accordance with the principles of the invention discussed above. Device 400 includes housing 431, trigger 434 mounted in housing 431, processor 432 mounted in housing 431, safety 433 mounted in housing 431, battery or batteries 435 mounted in housing 431, laser sight 436 mounted in housing 431, cartridge 437 removably mounted to housing 431, and annunciator 440 removably mounted to housing 431.

Cartridge 437 includes at least a first electrode 418 and a second electrode 420. Each electrode 418 (420) is connected to cartridge 437 by a suitable length of wire 416 (421). Each wire 416 (421) is coiled in cartridge 437 and unwinds and straightens as electrode 418 (420) travels through the air in the direction of arrow A toward a target. The length of each wire 416 (421) is typically 20 to 30 feet. Two or more cartridges 437 may be mounted on electronic control device 400.

Cartridge 437 also includes a propellant 425, compressed air, or other motive power means for launching each electrode 418 (420) through the air in the direction of arrow A toward a target. Cartridge 437 is activated and the electrodes 418 and 420 are launched by manually sliding safety 433 in a selected direction to release safety 433 and then squeezing to engage trigger 434. As described above, the means for generating the electrical pulses which travel into wires 416 and 421 and electrodes 418 and 420 is also activated by engaging trigger 434. Releasing safety 433 activates or turns "on" laser sight 436 such that at least one laser beam 435 projects outwardly in the direction of arrow A and impinges on the desired target.

Processor 432 preferably includes memory programmed to perform primary functions, record time of trigger operations, and method 300. Each time trigger 434 is engaged with a suitable cartridge or deployment unit, the memory in processor 432 retains a record of the date and time the electronic control device was fired.

Power for electronic control device 400 is provided by battery 435. Power can be provided by any conventional technology. When trigger 434 is squeezed to fire electronic control device 400, a signal is generated which is received by processor 432. Microprocessor 432 enables a primary function for about 5 seconds and begins measuring time intervals according to an implementation of method 300 (e.g., sequence 201, 211, 221, or 241).

Annunciator 440 may be removably mounted with battery 435 in a clip or power pack. By combining annunciator 440 with a battery pack, upgrades to electronic control devices in the field are simplified.

EXAMPLES OF THE INVENTION

The present invention includes systems and methods that alert a user before termination of a stun function of an electronic control device. Once alerted, the user may reengage a trigger to continue or resume the stun function.

For example, an electronic control device for impeding locomotion by a human or animal target may include a signal generator, two or more electrodes, a processor, a first timer, and an annunciator that cooperate to provide the characteristics or functions described herein. The signal generator generates a stimulus signal for producing contractions in skeletal muscles of the target to impede locomotion by the target. Coupled to the signal generator are electrodes for conducting an electric current through the target. A processor responsive to engagement of a trigger by a user controls the signal generator, the deployment of the electrodes, and an annunciator that alerts the user of an upcoming termination of a stun function of the signal generator.

The stimulus current from the signal generator may be deactivated in response to the first timer measuring a lapse of time from trigger engagement or generation of the stimulus current. Upon the lapse of time reaching a predetermined threshold, the stimulus current is deactivated. An annunciator provides the user with an indication prior to the deactivation of the stimulus current.

In another example of the present invention, a method performed by a processor for alerting a user prior to automatic shutoff of an electronic control device includes the steps in any order: generating a stimulus signal, providing a stimulus signal, measuring a first time period, measuring a second time period, deactivating the stimulus signal, and annunciating an alert.

The step of generating the stimulus signal is repeated in response to a trigger engagement. The stimulus signal is provided and the steps of measuring the first time period and second time period begin in response to the generation of the stimulus signal step. Upon the measurement of the first time period reaching a first predetermined value, the stimulus signal is deactivated (e.g., turned off). Upon the measurement of the second time period reaching a second predetermined value, the annunciator provides an alert to the user.

What is claimed is:

1. An electronic control device for impeding locomotion by a human or animal target when a plurality of electrodes of the electronic control device are electrically coupled to the target, the electronic control device comprising:

a signal generator to generate a stimulus signal when activated, the stimulus signal for producing contractions in skeletal muscles of the target to impede locomotion by the target;

an audio annunciator;

a trigger operated by a user of the electronic control device; and a processor that in response to an engagement of the trigger:

activates the signal generator;

deactivates the signal generator upon lapse of a first duration measured from the engagement;

maintains deactivation of the annunciator until lapse of a second duration measured from the engagement, the second duration being shorter in time than the first duration; and activates the annunciator in response to lapse of the second duration.

2. The electronic control device of claim 1 wherein the processor comprises a first timer to measure the first duration and a second timer to measure the second duration.

3. The electronic control device of claim 1 wherein the processor, in further response to a release of the trigger at a first time and a second engagement of the trigger at a second time, the first time before the second time, the second time during activation of the annunciator:

maintains activation of the signal generator without interruption;

deactivates the annunciator; and restarts measurement of the first duration and the second duration from the second engagement.

4. The electronic control device of claim 1 wherein the processor comprises a clock to measure at least one of the first duration and the second duration.

5. The electronic control device of claim 4 wherein the clock provides to the processor indicia of time.

6. A method performed by a timer of an electronic control device, the electronic control device including a circuit that generates a stimulus signal for causing contraction of skeletal muscles in a human or animal target, the method comprising:

measuring a first duration from a beginning of providing the stimulus signal to an end of providing the stimulus signal;

measuring a second duration from the beginning so that the second duration lapses before the end of providing the stimulus signal;

maintaining an audio annunciator of the electronic control device in a configuration so as to not provide indicia of alert before lapse of the second duration; and after lapse of the second duration and before lapse of the first duration, activating the audio annunciator to provide indicia of alert regarding the impending end of providing the stimulus signal.

7. The method of claim 6 wherein the electronic control device further includes a trigger operated by a user of the electronic control device, and the method further comprises providing the stimulus signal without interruption in response to an engagement of the trigger by the user after lapse of the second duration and before lapse of the first duration.

8. The electronic control device of claim 1 further comprising a replaceable module wherein the module comprises the annunciator and a battery that supplies power to the electronic control device.

* * * * *